US005906502A

United States Patent [19]

Fasano

[11] Patent Number: 5,906,502

[45] Date of Patent: May 25, 1999

[54] TWO WIRE TERMINATION CONNECTION STRIP

[75] Inventor: Michael Fasano, Huntington, N.Y.

[73] Assignee: Porta Systems Corp., Syosset, N.Y.

[21] Appl. No.: 08/986,806

[22] Filed: Dec. 8, 1997

[51] Int. Cl.[6] ..... H01R 4/24

[52] U.S. Cl. ..... 439/395; 439/404

[58] Field of Search ..... 439/290, 291, 439/395, 398, 402–404

[56] References Cited

U.S. PATENT DOCUMENTS

| | | | |
|---|---|---|---|
| 4,097,107 | 6/1978 | Hawkins . | |
| 4,220,390 | 9/1980 | Cobaugh et al. . | |
| 5,131,863 | 7/1992 | Gerke et al. | 439/395 |
| 5,588,859 | 12/1996 | Maurice | 439/290 |

OTHER PUBLICATIONS

Porta Systems Corporation, "Connection Strip Technical Manual", PRTA 636–135–200, Issue 4, Mar. 1995.

*Primary Examiner*—Khiem Nguyen
*Attorney, Agent, or Firm*—Hoffmann & Baron, LLP

[57] ABSTRACT

An insulation displacement contact for a two wire termination connection strip includes first and second generally planar leaf elements, each having longitudinal centerlines lying in a common longitudinal plane. The longitudinal plane is perpendicular to both of the leaf elements. The first leaf element is formed with a first leaf longitudinal slot defined by a first leaf relieved edge located on a first side of the longitudinal plane, and a first leaf opposed cutting edge which is spaced from the first leaf relieved edge in a direction towards the first leaf longitudinal centerline. The second leaf element is formed with a second leaf longitudinal slot defined by a second leaf relieved edge and a second leaf opposed cutting edge, with the second leaf relieved edge located on the second side of the longitudinal plane and the second leaf opposed cutting edge being spaced from the second leaf relieved edge in a direction towards the first leaf longitudinal centerline. The first and second leaf longitudinal slots define a tortuous path for receiving two insulated wires, with the cutting edges cutting through the insulation of the two insulated wires to make electrical contact and the relieved edges defining open regions which receive portions of the insulation of the insulated wires which are displaced from the wires, such that insulation displaced from the first wire does not interfere with placement of the second wire. The insulation displacement contacts are preferably employed with a connector block having an insulation-displacement-contact-receiving cavity defined by first and second pairs of generally parallel walls having a generally parallelogram cross section. The first pair of parallel walls are generally perpendicular to the longitudinal plane, while the second pair of parallel walls are generally sized and shaped to create back-up portions which back up the first and second leaf cutting edges when the contact is inserted into the cavity, such that the first and second cutting edges are moved towards the relieved edges and are substantially fixed against in-plane motion. The special shape for the insulation-displacement-contact-receiving cavity assists in preventing springing of the contact when the second wire is inserted.

13 Claims, 12 Drawing Sheets

TWO WIRE TERMINATION CONNECTION STRIP

BACKGROUND OF THE INVENTION

1. Field of the Invention

The present invention relates to electrical connectors, and more particularly relates to a two wire termination connection strip.

2. Description of the Prior Art

Many types of electrical connectors are known. In the field of telephony, one common type of connector assembly is the so-called connector block. Such blocks provide an interface, for example, between the internal telephone wires in a building structure and the external wires in an underground cable. Exemplary connector block assemblies are disclosed in U.S. Pat. No. 5,160,273 to Carney and U.S. Pat. No. 5,356,309 to Carney et al. The disclosure of both of these patents is expressly incorporated herein by reference.

Reference should be had to FIGS. 1 and 2, which are adapted from FIGS. 1 and 7 respectively of the Carney '273 patent. As shown therein, a prior art connector block 10 includes a contact holder portion 12 and a base portion 14. Contact holder portion 12 is formed with a plurality of slots 16, each of which has a wide portion 18 and a narrow portion 20. The wide portion 18 can receive and guide a wire into the narrow portion 20, which is preferably dimensioned to be less than the overall diameter of an insulated wire to be connected, yet greater than the diameter of the conductor portion of the wire. Thus, narrow portion 20 functions as a strain relief Contact holder 12 is formed with a plurality of internal cavities 22 for receiving insulation displacement contacts. Insulation displacement contacts 24 are inserted in cavities 22; the tails 26 of contacts 24 which are present in opposed cavities 22 touch and provide electrical contact.

Recently, it has become advantageous to be able to secure two wires in each slot 16, and thus in each insulation displacement contact 24. Such connections are desirable, for example, when installing additional equipment or extensions, and for other reasons known to those of skill in the art.

There are significant problems associated with attempting to secure two wires in prior art insulation displacement contacts, using prior art connector blocks. Reference should now be had to FIGS. 3A–3C which depict an insulation displacement contact 24 according to the prior art. The views are, respectively, a front, right side and rear view. FIGS. 3A and 3B depict the prior art insulation displacement contact 24 attached by its tail 26 to a forming strip 28, which is of use in manufacturing. Prior art contact 24 includes a V-groove 30 in both front and rear leaf elements 32,34. As an alternative, an opening with parallel sides, rather than a V-groove, can be used. In any event, it will be appreciated that when a wire is inserted in the V-grooves 30 of front and rear leaf elements 32,34, ears 36,38 separate. This effect is best seen in FIG. 4. As shown therein, as first wire 40 is inserted in V-groove 30, it spreads ears 36,38; they essentially bend as cantilevered beams. Thus, second wire 42 is not gripped securely when it is inserted. This can cause second wire 42 to be less securely retained than first wire 40. This effect is exacerbated by build up of insulation 44 which is sheared off of first wire 40 and then interferes with insulation 44 of second wire 42. Thus, there may not be room to fully receive second wire 42 into groove 30 due to interference from insulation 44. The interfering insulation and the spreading ears 36,38 which open up the V-groove 30 have made prior art insulation displacement contacts essentially unsuitable for use with two wires.

FIG. 5 depicts a prior art insulation displacement contact 24 secured in a prior art connector block contact holder 12. The insulation 44 of a wire 40 is secured by the strain relief elements 46 which define the narrow portions 20 of slot 16 (items 18 and 16 not labeled in drawing). It will be seen that both sides of insulation displacement contact 24 securely grasp the conductor of wire 40, however, it is also clear that there is no room for lateral displacement of insulation 44 and it will be substantially forced upward.

Reference should now be had to FIGS. 6A and 6B which are cross sections through the prior art connector block 10. In FIG. 6A, tails 26 of insulation displacement contacts 24 touch, and produce electrical contact between the two insulation displacement contacts 24. Contact is depicted by arrow 50. In FIG. 6B, tails 26 of contacts 24 are separated by a disconnect plug 48 formed from an insulating material. The separated contacts are indicated by arrow 52.

Reference should now be had to FIG. 7 which depicts a cross sectional plan view through a prior art contact holder 12 showing the insulation-displacement-contact-receiving cavity 22. The section is taken at a location where slots 16 have narrowed down to narrow part 20. It will be appreciated that cavity 22 includes a first pair of parallel walls 54 and a second pair of parallel walls 56 which are perpendicular to first pair of parallel walls 54. With continued reference to FIG. 7, and referring also back to FIG. 4, it will be appreciated that by making contact 24 a close fit in contact receiving cavity 22, spreading of V-groove 30 can be somewhat reduced by having ears 36,38 bear against walls 56. However, some clearance is generally necessary to insert contact 24. Further, the close fit can do nothing to alleviate the previously-discussed problem of interfering insulation, and may even exacerbate it.

At least one prior art device is specifically directed to terminating two wires in a single insulation displacement contact. U.S. Pat. No. 4,220,390 to Cobaugh et al. discloses a contact with three generally parallel leaf elements; two of which are essentially adjacent and have staggered offset slots which result in tighter gripping of wires when two wires are inserted. However, the construction of this device makes it not well suited for use in the confined spaces typical in modern telephone connector blocks. U.S. Pat. No. 5,588,859 to Maurice discloses a hermaphrodite contact having offset slots which are not staggered, and with two parallel leaf elements with no gap therebetween. It is not specifically directed to use with two wires, and although it has minimal depth, its relatively large width makes it undesirable for confined spaces. U.S. Pat. No. 5,131,863 to Gerke et al. discloses a cutting/clamping contact featuring a single plate-like element which is oriented at 45° to the wire with which contact is to be made. There is no specific adaptation for two wires. Contact integrity in the Gerke et al. device could potentially be compromised by any melting or other degradation of the plastic body.

U.S. Pat. No. 4,097,107 to Hawkins discloses an insulation displacement terminal with offset, dogleg slots which are sprung with respect to each other for secure retention of a single wire; however, once a single wire is inserted, the configuration changes such that a second wire cannot be inserted.

In view of the deficiencies of prior art devices, there is a need for a two wire termination connection strip which is simple to manufacture, and which can provide reliable termination of two wires. The device should be adaptable to existing systems. Furthermore, any spreading open of the device upon insertion of the first wire should be minimized, and preferably substantially eliminated. Yet further, adequate provision should be made to deal with displaced insulation.

OBJECTS AND SUMMARY OF THE INVENTION

It is an object of the present invention to provide a two wire termination connection strip which securely retains two wires.

It is another object of the present invention to provide a two wire termination connection strip in which undesirable "opening up" of the contact is reduced or eliminated.

It is yet another object of the present invention to provide a two wire termination connection strip which controls the location of displaced insulation so that there is little or no interference with placement of the second wire.

In accordance with one form of the present invention, an insulation displacement contact includes a first generally planar leaf element which has a first leaf longitudinal centerline lying in a longitudinal plane. The longitudinal plane is generally perpendicular to the first leaf element, and the first leaf element is formed with a first leaf longitudinal slot which is defined by a first leaf relieved edge and a first leaf opposed cutting edge which is spaced from the first relieved edge in a direction towards the first leaf longitudinal centerline. The first leaf relieved edge is located on a first side of the longitudinal plane.

The insulation displacement contact also includes a second generally planar leaf element which is secured to the first leaf element. The second leaf element has a second leaf longitudinal centerline which also lies in the longitudinal plane and the longitudinal plane is generally perpendicular to the second leaf element. The second leaf element is formed with a second leaf longitudinal slot defined by a second leaf relieved edge and a second leaf opposed cutting edge. The second leaf relieved edge is located on the second side of the longitudinal plane and the second leaf opposed cutting edge is spaced from the second leaf relieved edge in a direction towards the second leaf longitudinal centerline. The first leaf longitudinal slot and the second leaf longitudinal slot define a tortuous path for receiving two insulated wires, each of which has insulation and a conductor. The first leaf opposed cutting edge and the second leaf opposed cutting edge cut through the insulation of the two insulated wires, when the wires are received in the tortuous path, so as to make electrical contact with the conductors of the wires. The first leaf relieved edge and the second leaf relieved edge define open regions which receive portions of the insulation of the two insulated wires which are displaced from the wires.

The invention can also include a connector block which has an insulation-displacement-contact-receiving cavity defined therein by first and second pairs of parallel walls. The contact can be inserted in the cavity. The cavity is provided with a generally parallelogram cross section with a first pair of parallel walls oriented perpendicular to the longitudinal plane. The cavity has a longitudinal axis which lies generally in the longitudinal plane. The cavity also includes a second pair of parallel walls which are angled with respect to the first pair of parallel walls such that when the insulation displacement contact is inserted in the insulation-displacement-contact-receiving cavity, the first leaf cutting edge and the second leaf cutting edge are adjacent back-up portions of the second pair of parallel walls which angle towards the cutting edges and which back up the cutting edges, such that the cutting edges are moved in a direction towards the longitudinal plane and are substantially fixed against in-plane motion.

It is to be understood that the invention includes the individual contact and connector block, as well as the combination of the contact and the connector block, and further, the combination of the wire or wires, contact and connector block.

In a preferred form of the present invention, the first and second leaf cutting edges are pushed beyond the longitudinal plane when the insulation displacement contact is inserted in the insulation-displacement-contact-receiving cavity. Preferably, the cutting edges are spaced at least as far away from the relieved edges as the longitudinal centerlines, when the insulation displacement contact is not inserted in the insulation-displacement-contact-receiving cavity, and are then pushed back across the longitudinal plane towards the relieved edges when the contact is inserted in the cavity. Further, it is preferable that when the contact is inserted in the cavity, the first and second leaf relieved edges are adjacent clearance portions of the second pair of parallel walls which angle away from the relieved edges such that the relieved edges are substantially free to move in plane.

In the preferred form of the present invention, the first leaf element can be divided into a first leaf first prong located on the first side of the longitudinal plane and bounded by the first leaf relieved edge and a first leaf second prong located on the second side of the longitudinal plane and bounded by the first leaf opposed cutting edge. Further, the second leaf element can be divided into a second leaf first prong located on the second side of the longitudinal plane and bounded by the second leaf relieved edge and a second leaf second prong located on the first side of the longitudinal plane and bounded by the second leaf opposed cutting edge. The second leaf first prong is joined to the first leaf second prong to form a second-side path-bounding arm and the second leaf second prong is joined to the first leaf first prong to form a first-side path-bounding arm. In contrast with the predominantly bending load applied in prior-art devices, the first and second side path-bounding arms are preferably subjected to substantial torsional loads about axes parallel to the longitudinal plane when the two insulated wires are inserted in the tortuous path, such that the first leaf first prong and second leaf first prong twist towards the clearance portions of the second pair of parallel walls in the connector block. Most preferably, the tortuous path has an open end for receiving the two wires, the second leaf first prong is joined to the first leaf second prong adjacent the open end of the tortuous path and the second leaf second prong is joined to the first leaf first prong adjacent the open end of the tortuous path. The prongs are preferably joined with radiused loop portions and the leaf elements preferably form an angle of about 3–15° before the insulation displacement contact is inserted in the cavity of the connector block, with an angle of about 3° after insertion.

A method, according to the present invention, of securing two insulated wires, each of which has insulation and a conductor, comprises the steps of providing an insulation displacement contact; supporting the insulation displacement contact in a connector block; and inserting two insulated wires into a tortuous path defined by the insulation displacement contact. More specifically, the insulation displacement contact which is provided can include first and second generally planar leaf elements of the type previously discussed, wherein the first leaf longitudinal slot and second leaf longitudinal slot define a tortuous path for receiving the two insulated wires and the first leaf relieved edge and second leaf relieved edge define open regions for receiving portions of the insulation of the two insulated wires which are displaced from the insulated wires during subsequent insertion.

In the supporting step, the insulation displacement contact is preferably supported in a connector block of the type described above. The second pair of parallel walls are preferably sized and shaped to provide back-up portions which back up the cutting edges, such that when the contact is supported in the cavity of the connector block, the back-up portions back up the first and second leaf cutting edges and cause them to more towards the first and second leaf relieved edges and substantially fix them against in-plane motion. In the inserting step, the two insulated wires are inserted into the tortuous path defined by the first and second leaf longitudinal slots such that the first and second leaf opposed cutting edges cut through the insulation of the two insulated wires to make electrical contact with the conductors of the wires, and such that the open regions defined by the first and second leaf relieved edges received portions of the insulation of the two insulated wires which are displaced from the wires.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
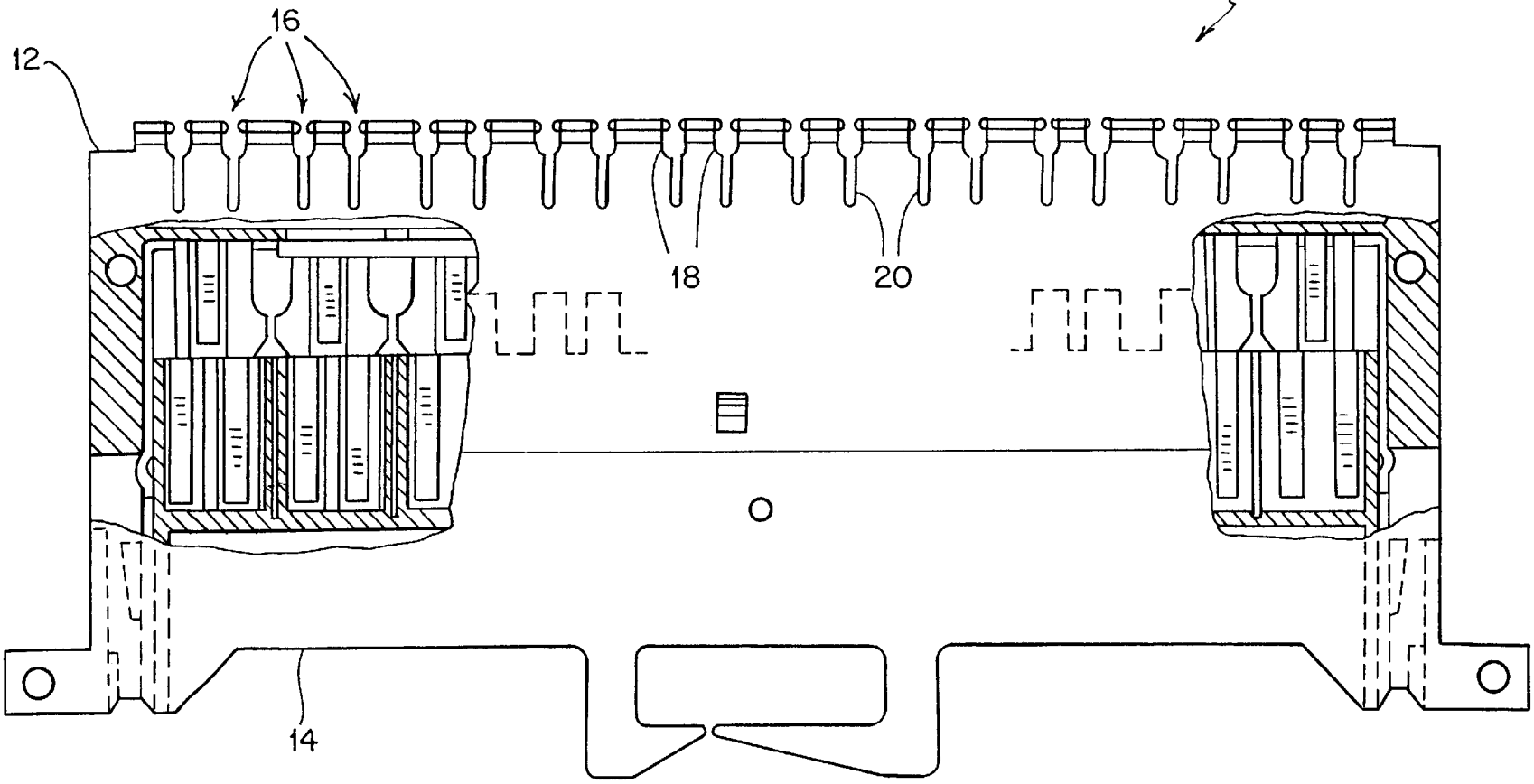
FIG. 1 (PRIOR ART)
FIG. 1 is a front elevational view, partially in cross-section, of a prior art connector block.

Reference should first be had to FIGS. 8A–8C and 11, which depict an insulation displacement contact 100 in accordance with the present invention. Insulation displacement contact 100 includes a first generally planar leaf element 102. First leaf element 102 has a first leaf longitudinal centerline 104 best seen in FIGS. 8A, 8B and 11. First leaf longitudinal centerline 104 lies in a longitudinal plane (item 130 in FIG. 10-discussed below) which is perpendicular to the plane of the paper in FIG. 8A and which intersects the first leaf element 102 along centerline 104. First leaf element 102 is formed with a first leaf longitudinal slot 106 which is defined by a first leaf relieved edge 108 and a first leaf opposed cutting edge 110 which is spaced from the first leaf relieved edge 108. The first leaf relieved edge 108 is located on a first side of the longitudinal plane 130. The first leaf opposed cutting edge 110 is spaced from the first leaf relieved edge 108 in a direction towards the first leaf longitudinal centerline 104. As depicted in the figures, it is preferably located at least as far away from edge 108 as centerline 104, and most preferably is slightly beyond the longitudinal centerline 104 and has a slight angle to it, analogous to the V-groove 30 of the prior art device. However, cutting edge 110 can be on either side of centerline 104 so long as it is spaced from relieved edge 108 in a direction towards centerline 104.

The insulation displacement contact 100 also includes a second generally planar leaf element 112 which is secured to the first leaf element 102. The second leaf element 112 has a second leaf longitudinal centerline 114 which lies in the longitudinal plane 130. The longitudinal plane 130 is generally perpendicular to the second leaf element 112. As best see in FIG. 8C, second leaf element 112 is formed with a second leaf longitudinal slot 116 which is defined by a second leaf relieved edge 118 and a second leaf opposed cutting edge 120. The second leaf relieved edge 118 is located on the second side of the longitudinal plane 130 and the second leaf opposed cutting edge 120 is spaced from the second leaf relieved edge 118 in a direction towards the second leaf longitudinal centerline 114. As for the first leaf, in a preferred form of the invention, the second leaf opposed cutting edge 120 is preferably located at least as far away from edge 118 as centerline 114, and most preferably is slightly beyond centerline 114 and angled slightly away from the longitudinal centerline 114 in a manner similar to the V-groove 30 of the prior art device. Of course, non-angled cutting edges 110, 120, or any other suitable configuration can also be used. Further, as for edge 110, cutting edge 120 can be on either side of centerline 114 so long as it is spaced from relieved edge 108 in a direction towards centerline 114.

Figure 10:
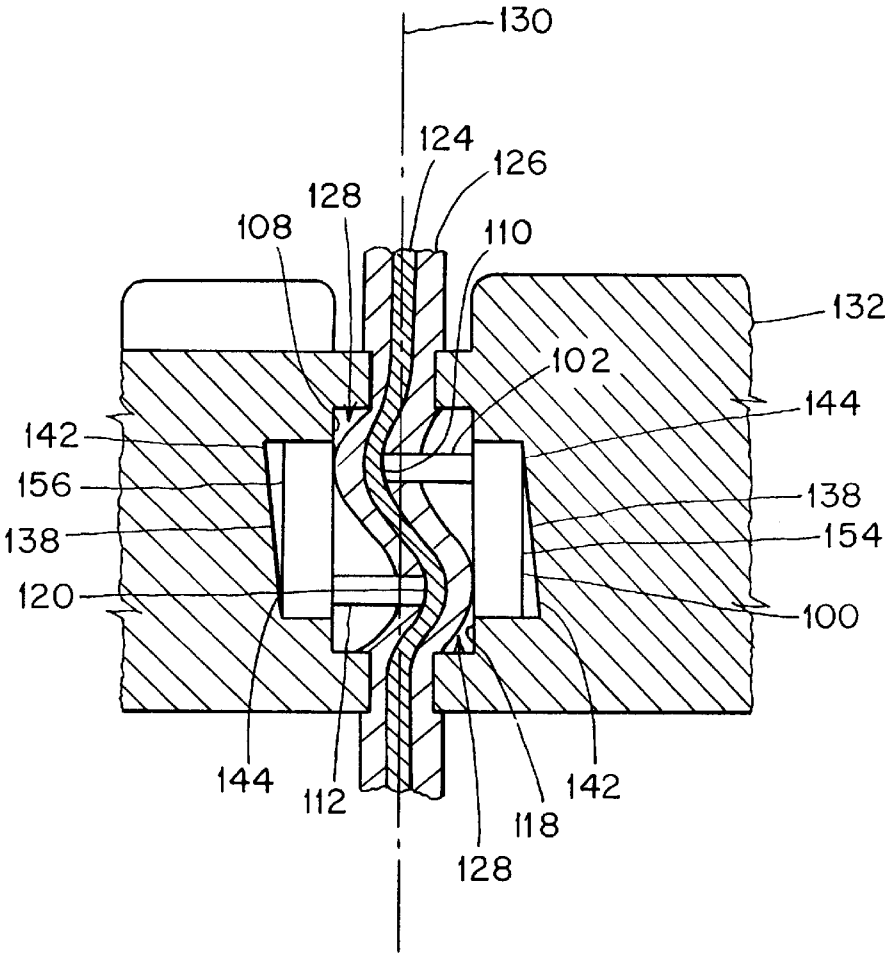
FIG. 10 is a top-plan view, partially in cross-section, showing an insulation displacement contact of the present invention seated in a connector block of the present invention and with a wire inserted therein.
Figure 12:
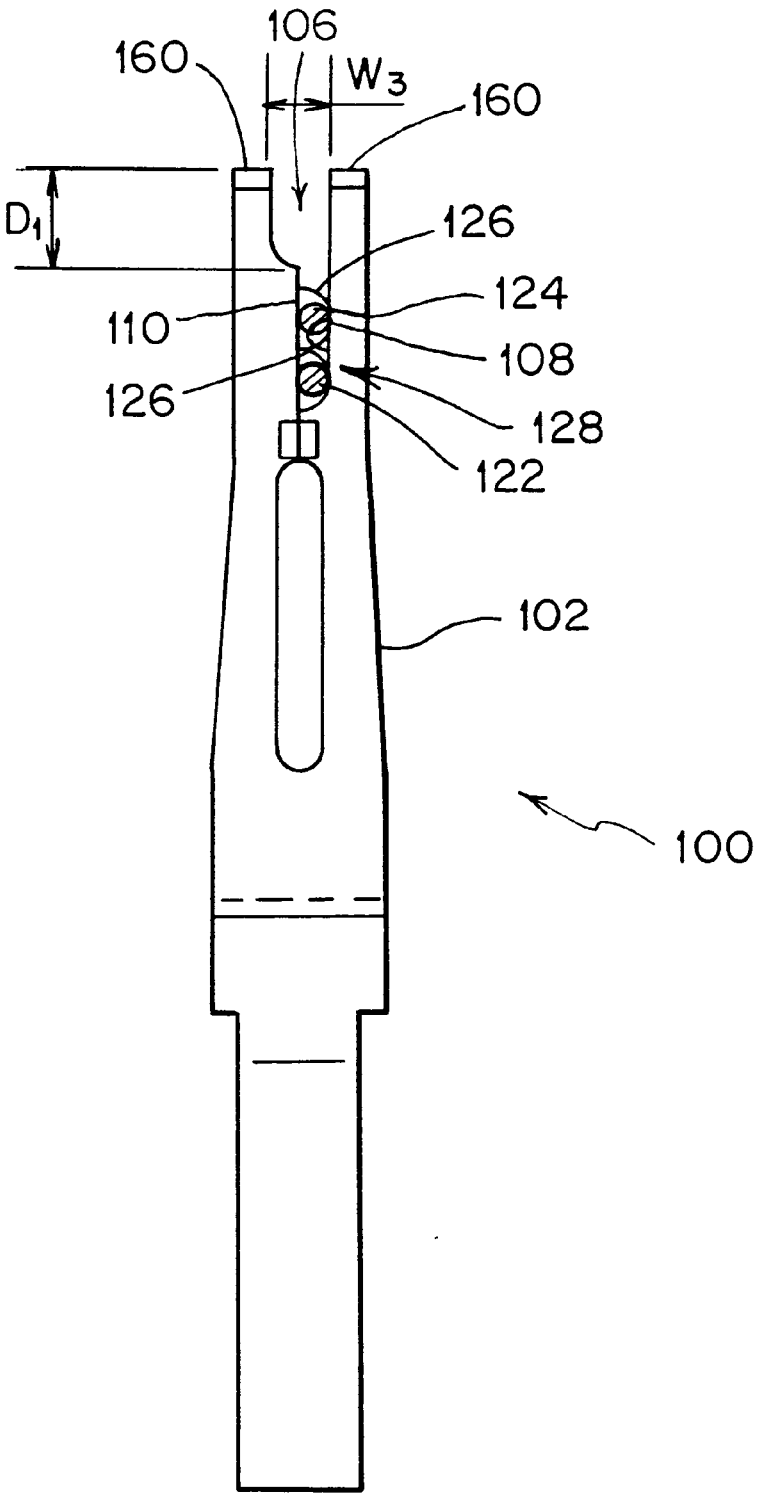
FIG. 12 is a front elevational view of the insulation displacement contact of the present invention with two wires inserted therein.

With additional reference now to FIGS. 10 and 12, it will be appreciated that the first leaf longitudinal slot 106 and the second leaf longitudinal slot 116 define a tortuous path for receiving two insulated wires 122,124. The first leaf opposed cutting edge 110 and the second leaf opposed cutting edge 120 cut through the insulation 126 of the two insulated wires 122,124, when the wires are received in the tortuous path. Thus, electrical contact is made between the insulation displacement contact 100 and the conductors of the wires 122,124. Further, it will be appreciated that the first leaf relieved edge 108 and the second leaf relieved edge 118 define open regions 128 which receive portions of the insulation 126 which are displaced from the wires 122,124. Note that FIG. 10 also depicts a line 130 representing the aforementioned longitudinal plane, which is perpendicular to the paper in FIG. 10. Note also that, for convenience, portions of the insulation displacement contact below the plane of the paper in FIG. 10 are not depicted, and the insulation displacement contact itself is not depicted in section but rather in an ordinary top plan view.

Figure 2:
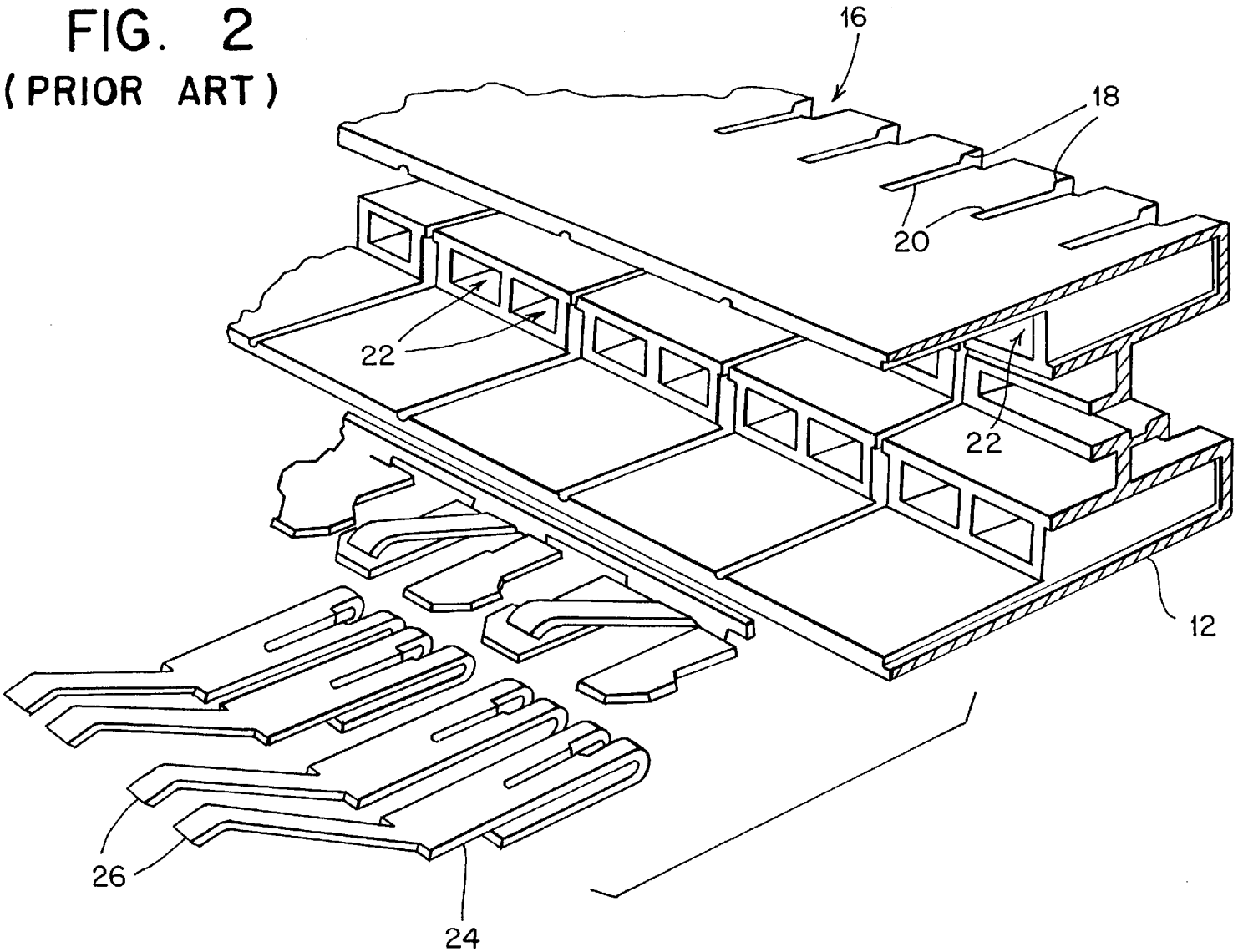
FIG. 2 (PRIOR ART)
FIG. 2 is a cut-away, partially exploded perspective view of the block of FIG. 1.
Figure 3A:
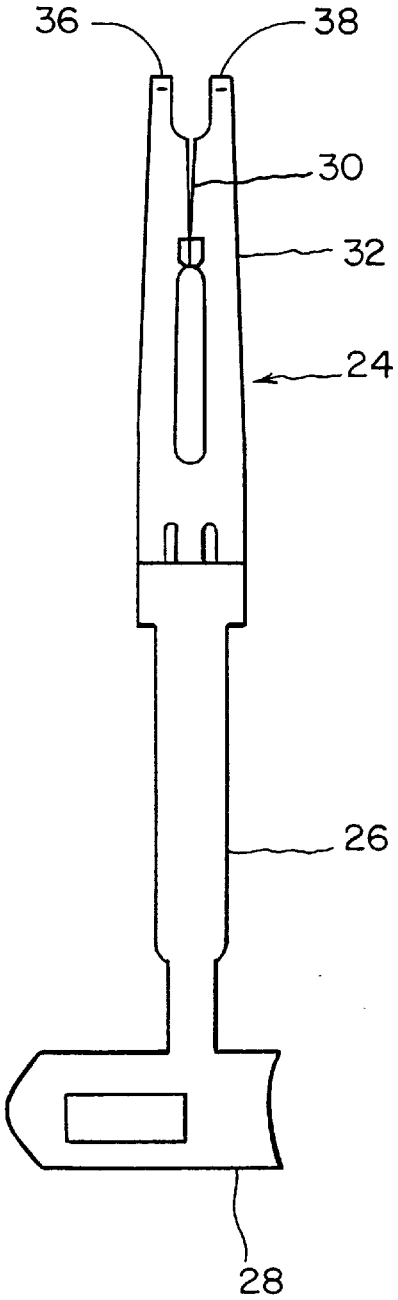
FIG. 3A ( PRIOR ART )
FIG. 3A is a front orthographic view of a prior-art insulation displacement contact.
Figure 3B:
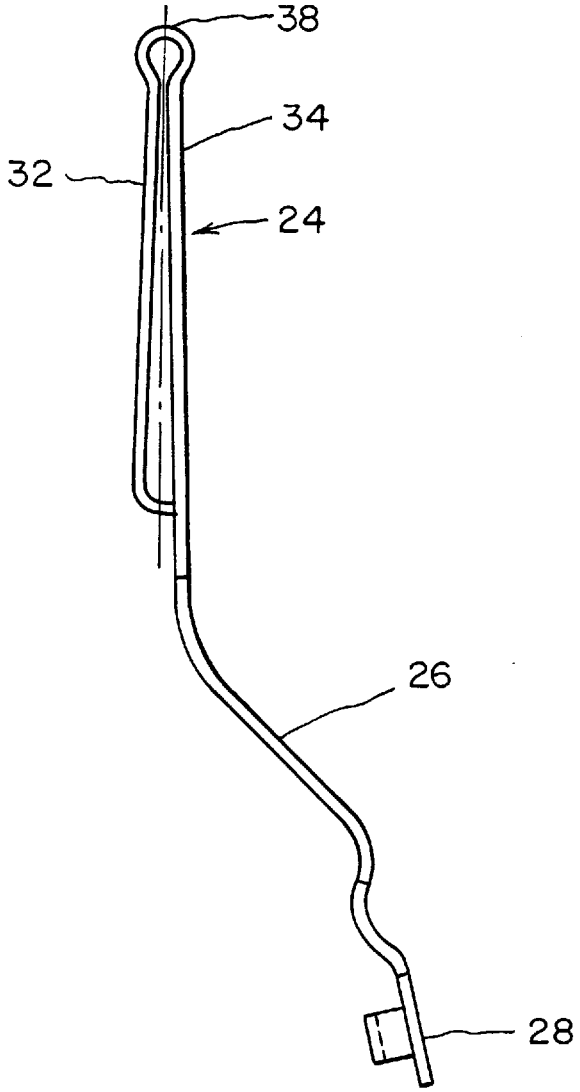
FIG. 3B ( PRIOR ART )
FIG. 3B is a right side view of the contact of FIG. 3A.
Figure 3C:
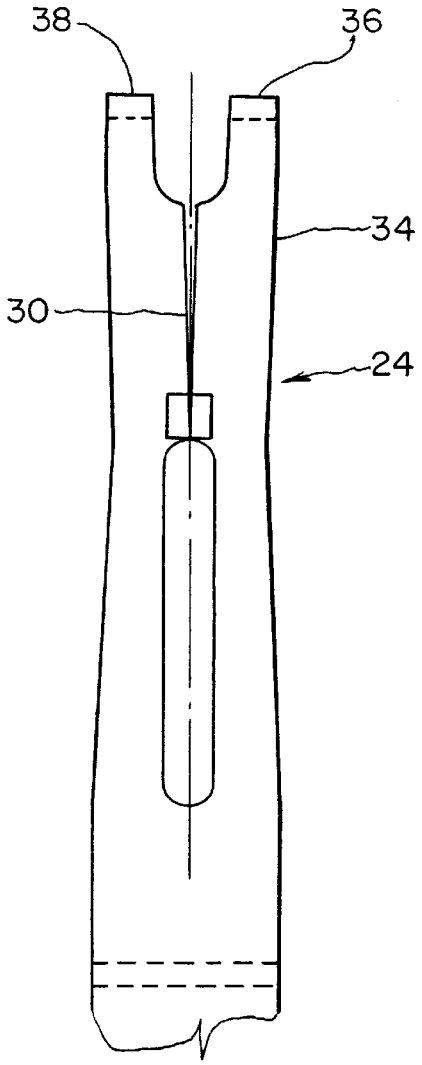
FIG. 3C (PRIOR ART)
FIG. 3C is a rear orthographic view of the device of FIG. 3A.
Figure 4:
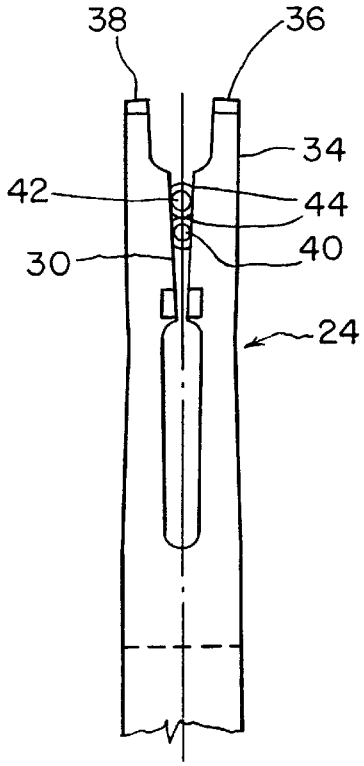
FIG. 4 (PRIOR ART)
FIG. 4 is a view similar to FIG. 3C showing the prior art device with two wires inserted therein.
Figure 5:
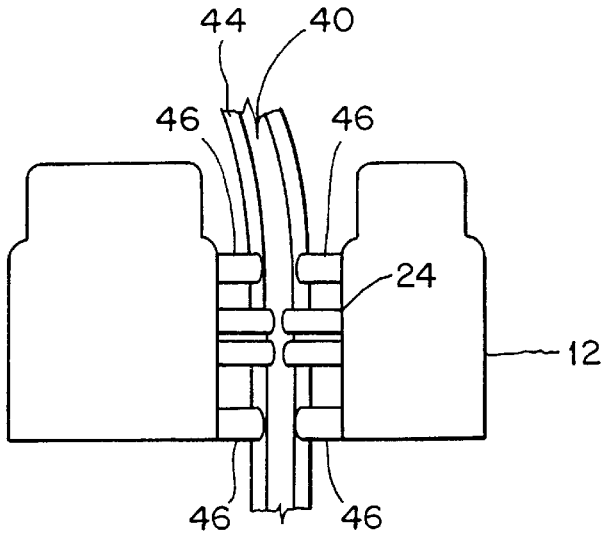
FIG. 5 (PRIOR ART)
FIG. 5 is a top plan view, partially in cross section, of a wire inserted into the block of FIGS. 1 and 2.
Figure 6A:
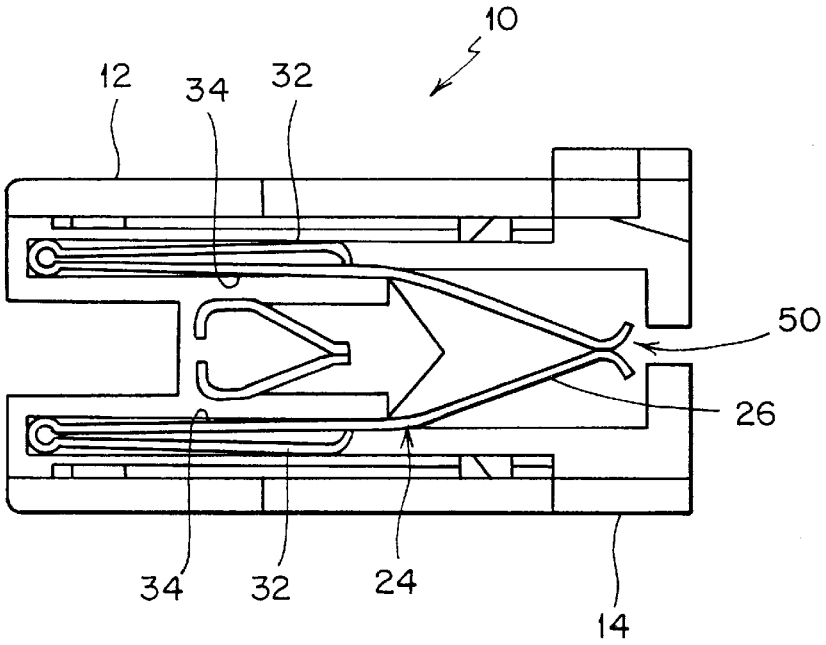
FIG. 6A (PRIOR ART)
FIG. 6A is a cross sectional view through the block of FIG. 1, taken in side elevation, showing contacting adjacent insulation displacement contacts.
Figure 6B:
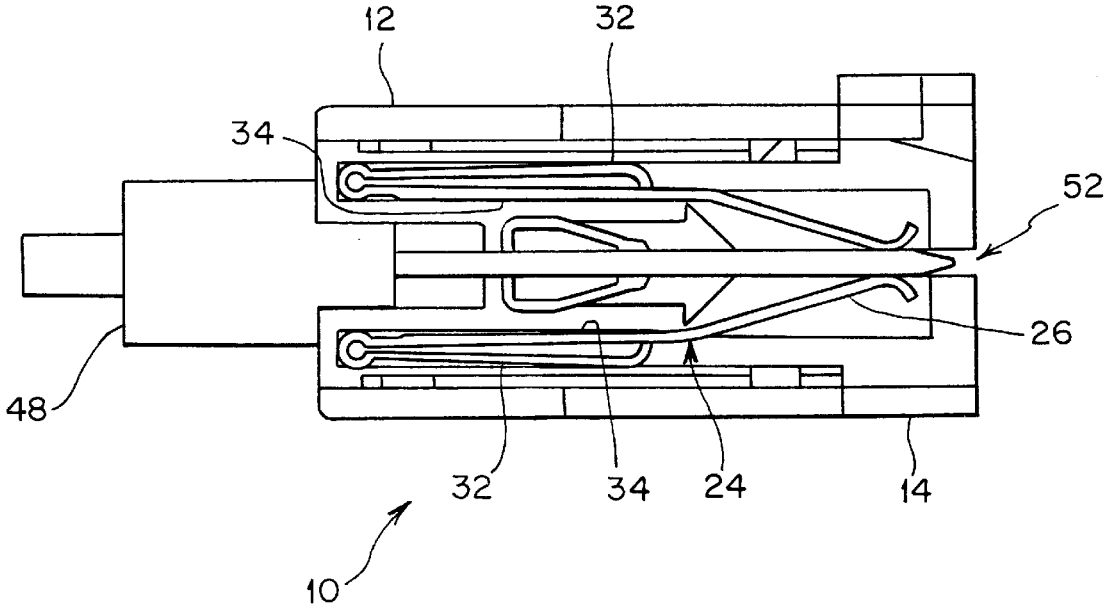
FIG. 6B (PRIOR ART)
FIG. 6B is a view similar to FIG. 6A but showing a disconnect plug in place.
Figure 7:
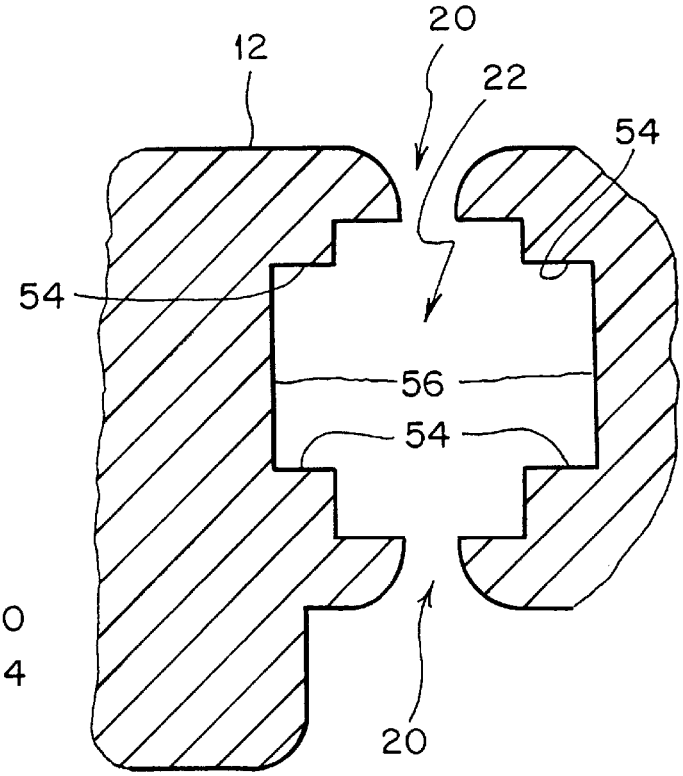
FIG. 7 is a partial cross sectional view, taken in top-plan, of the block of FIGS. 1 and 2, showing the profile of an insulation-displacement-contact-receiving cavity thereof.
Figure 9:
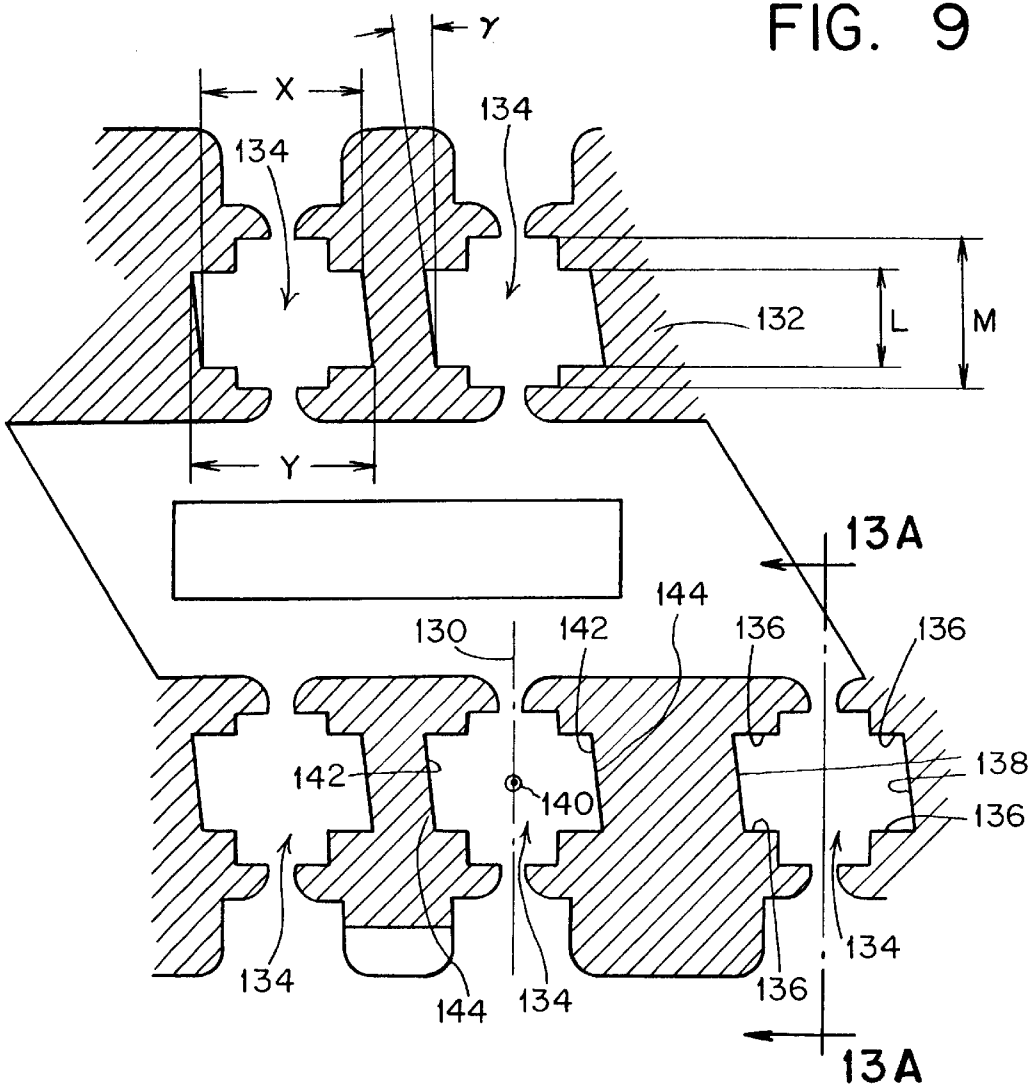
FIG. 9 is a cross-sectional view, taken in top-plan, of a connector block of the present invention which is similar to that shown in FIG. 1, except for having a special inventive profile for the insulation-displacement-contact-receiving cavity.

A connector block in accordance with the present invention will now be described. The block is preferably substantially identical to the prior art device 10 discussed above and depicted in FIGS. 1 and 2, except that the inventive connector block of the present invention includes a special shape for the insulation-displacement-contact-receiving cavities which makes it especially suitable for use with the inventive insulation displacement contact of the present invention. Reference should now be had to FIGS. 9 and 10 which depict the particular features of the inventive connector block of the present invention. Both FIGS. 9 and 10 are partial cross-sectional plan views, with block 132 being in cross section, showing the cross section of the receiving cavities 134 of the present inventive connector block. The connector block 132 includes at least one insulation-displacement-contacting-receiving cavity 134 defined by first and second pairs of generally parallel walls 136,138. As best seen in FIG. 10, contact 100 can be inserted in cavity 134. Cavity 134 preferably has a generally parallelogram cross section with the first pair of parallel walls 136 oriented perpendicular to the longitudinal plane 130 and the second pair of parallel walls 138 angled with respect to the first pair of parallel walls 136. Walls 136, 138 are preferably perpendicular to the plane of the paper in FIG. 9. Each cavity 134 has a longitudinal axis 140 lying generally in longitudinal plane 130. (Each cavity and associated contact have their own plane 130.) Longitudinal axis 140 is depicted as an arrow head perpendicular to the plane of the paper in FIG. 9. Second pair of parallel walls 138 are angled with respect to first pair of parallel walls 140 such that when insulation displacement contact 100 is inserted into insulation-displacement-contact-receiving cavity 134, the first leaf cutting edge 110 and the second leaf cutting edge 120 are adjacent back-up portions 144 of the second pair of parallel walls 138 which angle towards the cutting edges 110,120 and which back up the cutting edges. Thus, the cutting edges 110,120 are substantially fixed against in-plane motion (i.e., motion in the plane of the first and second generally planar leaf elements 102,112 respectively). The back-up portions 144 are configured to move the cutting edges in a direction towards the corresponding relieved edges.

Preferably the first leaf relieved edge 108 and the second leaf relieved edge 118 are adjacent clearance portions 142 of the second pair of parallel walls 138. Clearance portions 142 preferably angle away from the relieved edges 108,118, such that the relieved edges 108,118 are substantially free to move in the plane of the leaf elements 102,112. Note that, as used herein, "clearance portions" means portions with more clearance than in the area of the back-up portions; the clearance portions can preferably have, but do not require, a clearance fit.

In one preferred form of connector block 132, in accordance with the present invention, which is particularly suited for use with a preferred form of insulation displacement contact discussed below, the dimension X can be about 0.117 inches (2.97 mm) and the dimension Y can be about 0.134 inches (3.40 mm). The angle $\gamma$ can be about 6.6°. Any suitable value for these dimensions can be employed. Further, walls 138 need not be flat and angled; any configuration which gives suitable back-up portions 144 can be employed (for example, a bump on a flat surface). In practice, it has been found that the dimensions can be selected as follows. The back-up portions 144 are preferably sized to move the corresponding cutting edges 110,120 approximately 0.010–0.020 inches beyond the longitudinal plane 130. The 0.010–0.020 inch value is selected for an insulation displacement contact having the exemplary dimensions discussed below. Contacts and connector blocks dimensioned for other sizes of wire can be scaled accordingly. Note that within the exemplary preferred range of 0.010 inches–0.020 inches, a value of 0.015 inches is most preferred.

In view of the foregoing, it will be appreciated that in a particularly preferred form of the present invention, cutting edges 110,120 are preferably pushed beyond plane 130 when contact 100 is inserted in cavity 134. Furthermore, in the preferred insulation displacement contact, the cutting edges 110,120 are not merely spaced respectively from the first and second leaf relieved edges 108,118 towards the respective leaf longitudinal center lines 104,114, but they actually are located at or slightly beyond the centerlines when the insulation displacement contact 100 is not in the cavity 134; as discussed above, they then are pushed back over the longitudinal plane 130 by the back-up portions 144 upon insertion of contact 100 into cavity 134.

In a particularly preferred form of insulation displacement contact, in accordance with the present invention, and as depicted in the figures, the first leaf element 102 is divided into a first leaf first prong 146 and a first leaf second prong 148. The first leaf first prong 146 is located on the first side of the longitudinal plane 130 and is bounded by the first leaf relieved edge 108. The first leaf second prong 148 is primarily located on the second side of the longitudinal plane 130 and is bounded by the first leaf opposed cutting edge 110.

Similarly, in the particularly preferred form of contact, the second leaf element 112 is divided into a second leaf first prong 150 and a second leaf second prong 152. The second leaf first prong 150 is located on the second side of the longitudinal plane 130 and is bounded by the second leaf relieved edge 118. The second leaf first prong 150 is joined to the first leaf second prong 148 to form a second-side path-bounding arm 154. Similarly, the second leaf second prong 152 is joined to the first leaf first prong 146 to form a first-side path-bounding arm 156. The second leaf second prong 152 is primarily located on the first side of the longitudinal plane 130 and is bounded by the second leaf opposed cutting edge 120.

Figure 11:
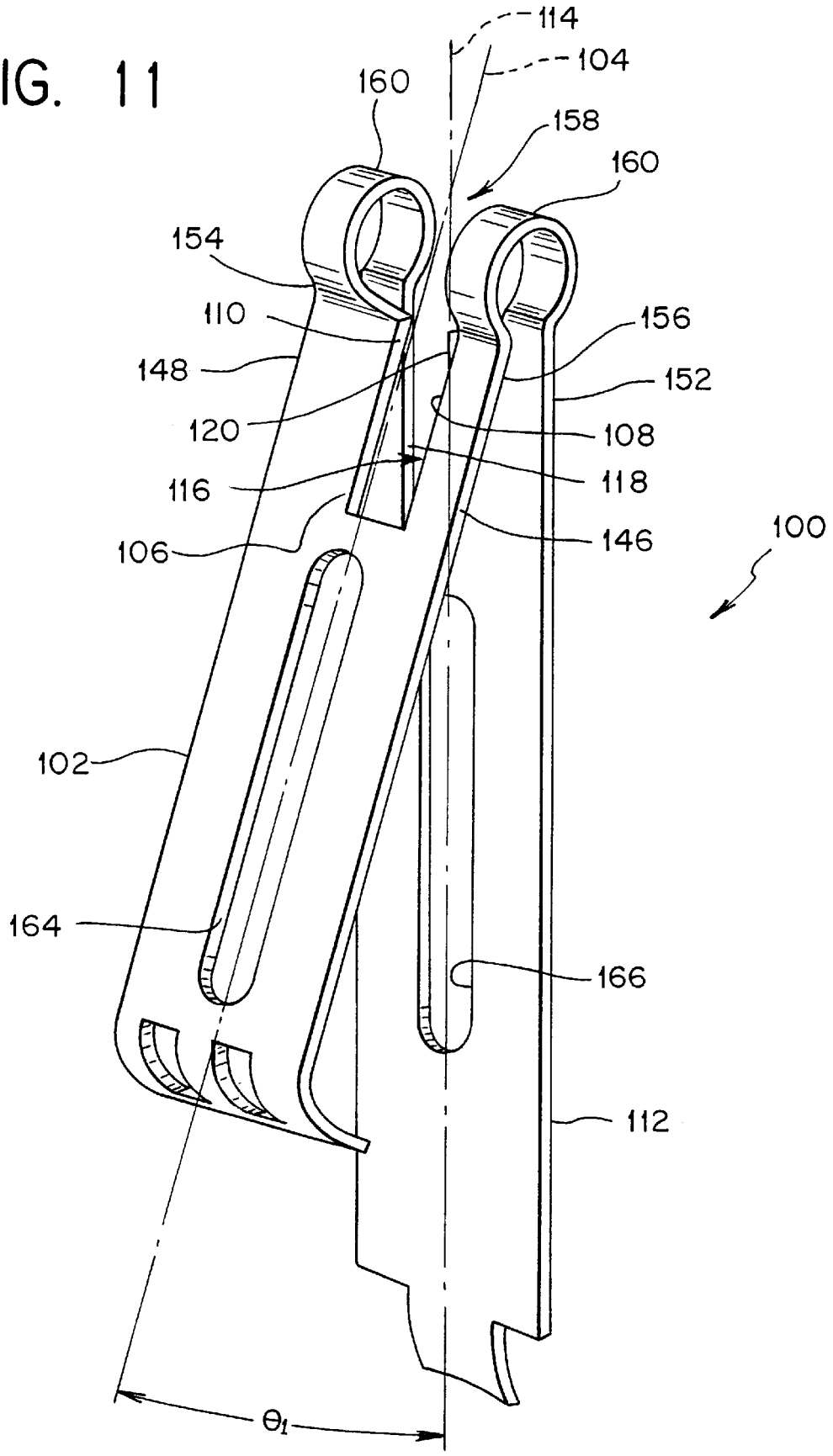
FIG. 11 is a perspective view of the insulation displacement contact of the present invention.

With reference now to FIGS. 9, 10 and 11, it will be appreciated that in one preferred form of the invention, the first and second side path bounding arms 156,154 are subjected to substantial torsional loads about axes generally parallel to the longitudinal axis 140 (and thus to plane 130)

when the two insulated wires 122,124 are inserted in the tortuous path formed by the first leaf longitudinal slot 106 and the second leaf longitudinal slot 116. Note that the axes about which the torsional loads are applied, which are parallel to the longitudinal axis 140 and plane 130, would be perpendicular to the paper in FIG. 10. Thus, the first leaf first prong 146 and the second leaf first prong 150 (see FIG. 8C) twist towards the clearance portions 142 of the second pair of parallel walls 138. It is to be understood that in many embodiments of the invention, such as that depicted in FIG. 11, the arms 154,156 are complex structures including two plate elements and thus, the loading is not purely a torsional one as would be encountered for, say, a circular rod. However, the terminology of a substantial torsional load is used to distinguish the loading of the present invention from that encountered in prior art V-grooved devices, wherein ears 36,38 are primarily subjected to bending loads.

Preferably, the tortuous path formed by the first leaf longitudinal slot 106 and the second leaf longitudinal 116 has an open end 158 for receiving the two wires 122,124. The second leaf first prong 150 is preferably joined to the first leaf second prong 148 adjacent the open end 158 of the tortuous path and the second leaf second prong 152 is preferably joined to the first leaf first prong 146 adjacent the open end of the tortuous path 158. Most preferably, the prongs are joined to each other via radiused loop portions 160.

In a preferred form of the insulation displacement contact of the present invention, as illustrated in the drawings, the first leaf element 102 and the second leaf element 112 form an angle $\theta_1$ which is about 3–15° when the insulation displacement contact 100 is not inserted in the insulation-displacement-contact-receiving cavity 134 of the connector block 132. This condition is depicted in FIG. 11. When the insulation displacement contact 100 is inserted in the contact-receiving cavity 134 of the connector block 132, the first leaf element 102 and the second leaf element 112 preferably form an angle $\theta_2$ of about 3°, as shown in FIG. 8B. Note that FIG. 8B depicts a small hook portion 162 of first leaf element 102 as touching second generally planar leaf element 112. However, hook 162 need not necessarily touch second leaf element 112, even when contact 100 is inserted in contact-receiving cavity 134.

It is to be understood that the present invention includes the insulation displacement contact, such as the exemplary contact 100, individually; the new connector block, such as the exemplary connector block 132, individually; and the combination of the insulation displacement contact 100 and connector block 132. Furthermore, the invention includes the combination of these components with at least one, and normally a pair, of insulated wires such as wires 122,124.

The insulation displacement contact 100 of the present invention can be made from, for example, beryllium copper having a thickness of about 0.010–0.016 inches (0.25–0.41 mm). Cutting edges 110,120 can, as noted, preferably lie on the respective centerlines 104,114, or can most preferably lie approximately 0.004 inches (0.10 mm) beyond the centerlines opposed to the relieved edges 108,118. They can, as noted, also be angled. The foregoing discussions refer to a non-inserted condition. The insulation displacement contact 100 of the present invention can be utilized with wires having an identical gage, or even those separated by one gage size, for example, AWG 22 and AWG 24. In addition to the aforementioned beryllium copper, copper alloy 510 in spring temper, phosphor bronze, can be employed. The connector block 132 can be made, for example, from a suitable injection-moldable electrically insulating plastic resin, such as GE Lexan 940 UL 94 VO rated. It should be appreciated that the connector block 132 can be constructed in a manner similar to the prior art connector block 10, including portions analogous to the contact holder 12 and base 14. Of course, the parallelogram insulation-displacement-contact-receiving cavities 134 would normally be positioned in the portion analogous to the contact holder 12.

Figure 8C:
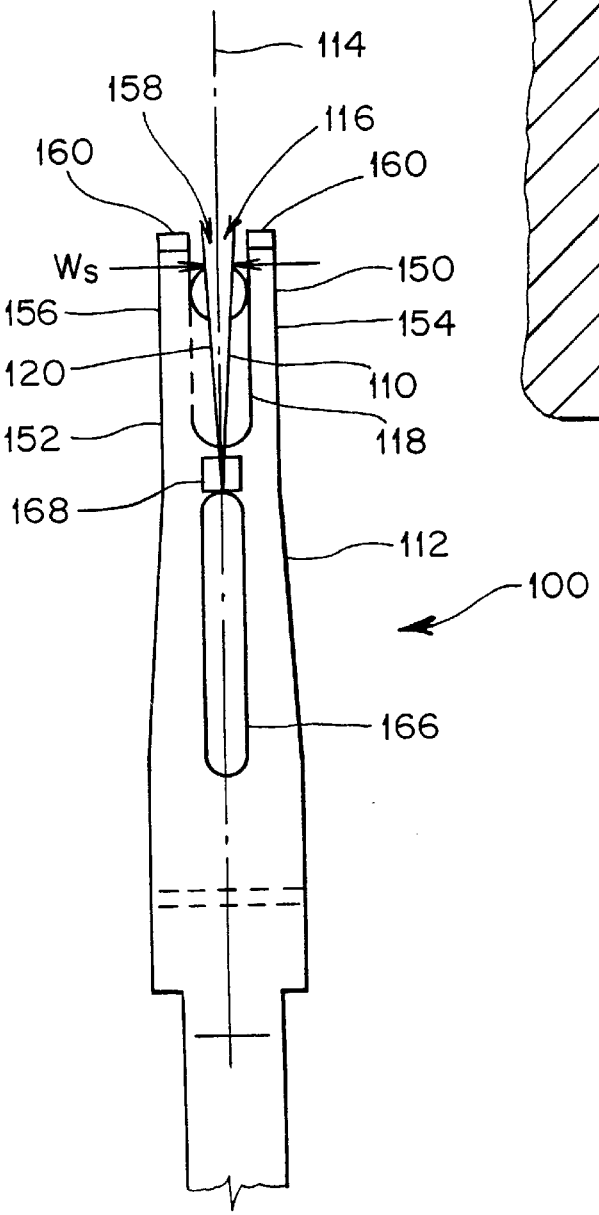
FIG. 8C is a rear orthographic view of the device of FIG. 8A.
Figure 8A:
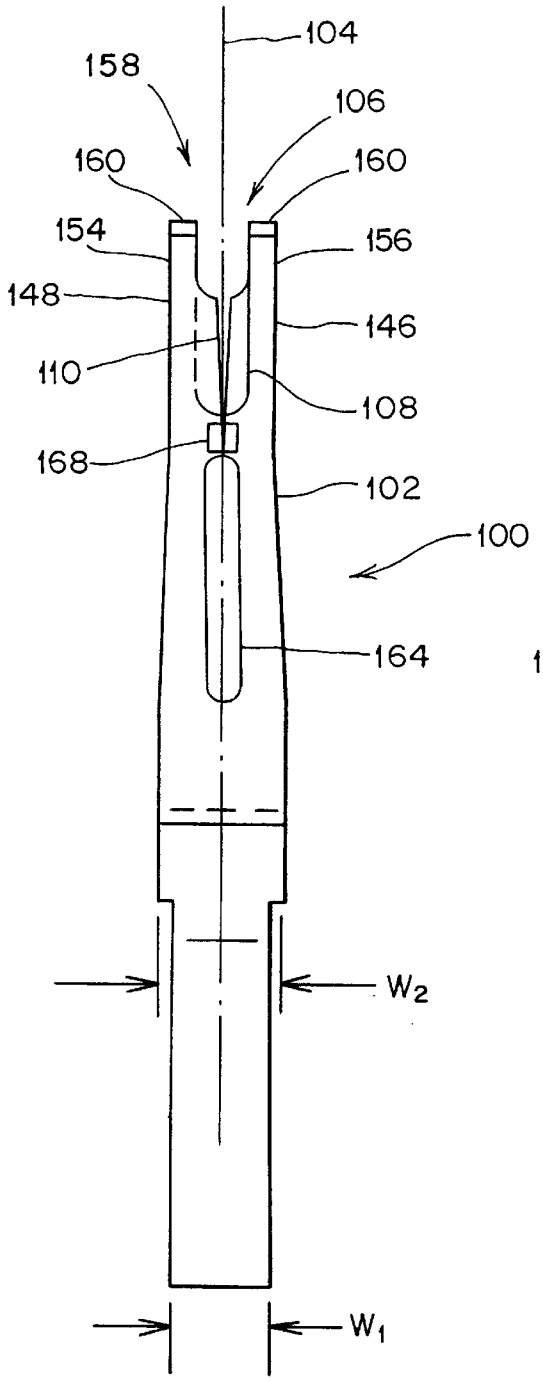
FIG. 8A is a front orthographic view of an insulation displacement contact in accordance with the present invention.
Figure 8B:
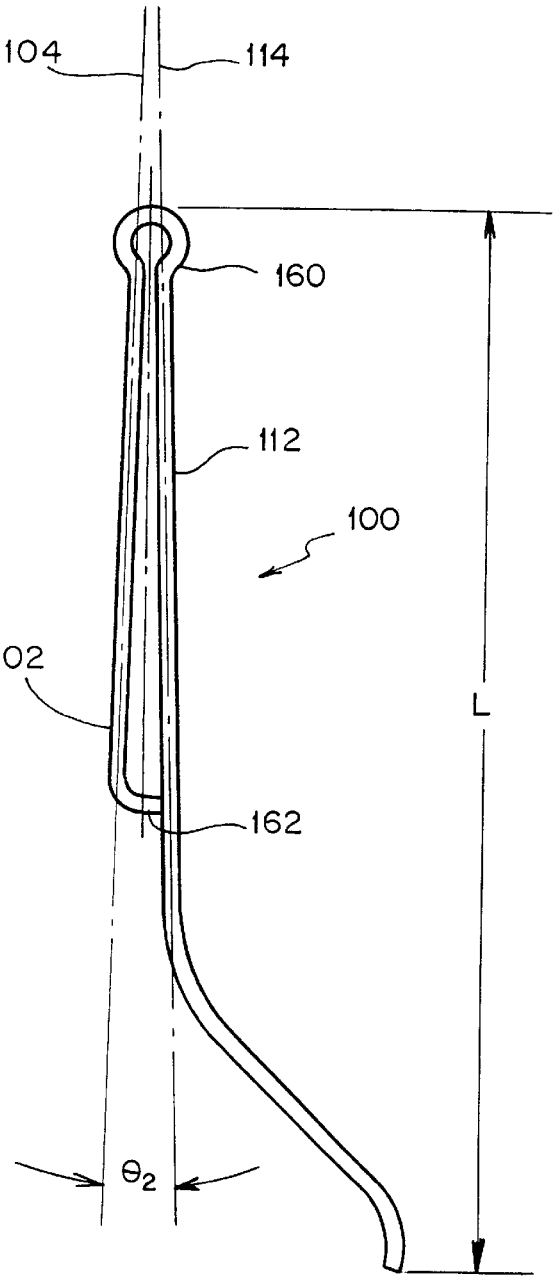
FIG. 8B is a right side orthographic view of the contact of FIG. 8A.

With reference to FIGS. 8A and 8B, dimension L can be, for example, 1.106 inches (28.1 mm); dimension $W_1$ can be 0.090 inches (2.3 mm); and dimension $W_2$ can be 0.135 inches (3.4 mm). It should be understood that all dimensions are exemplary and can be varied widely depending on the particular application. With reference to FIG. 12, width $W_3$ can be, for example, 0.062 inches (1.6 mm) and depth $D_1$ of the point of the cutting edge 110 below the top surface of the radiused loop portion 160 can be, for example 0.080 inches (2.0 mm). Referring back again to FIG. 8A, the first leaf longitudinal slot and second leaf longitudinal slot 106,116 preferably extend into elongate open regions 164,166 of the first leaf element 102 and second leaf element 112 respectively. Each of the first leaf element 102 and the second leaf element 112 can have a coined area 168 between the longitudinal slot 106,116 and the elongate opening 164,166 in order to aid in opening of the longitudinal slots 106,116. The coining provides separation of the slots. More particularly, with reference to FIG. 8C, coining provides dimension $W_S$ which corresponds to the opening between the opposed cutting edges 110,120. This can be, for example, about 0.008 inches (0.2 mm). The foregoing dimensions are for a non-inserted condition. It has been found that a contact with the foregoing dimensions can be utilized even with wires of two different guages, for example, AWG 22 and AWG 24.

Figure 13A:
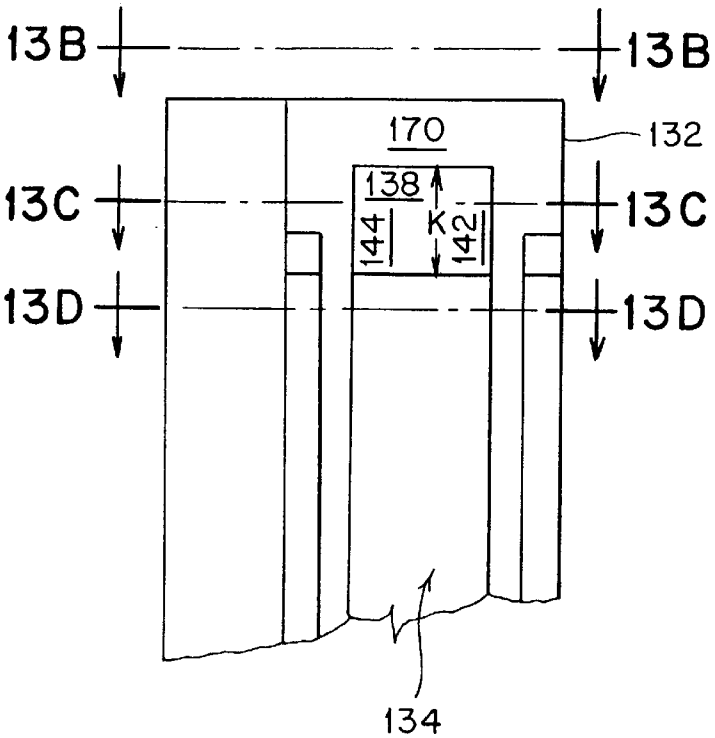
FIG. 13A is a transverse elevational view taken in direction 13A—13A as depicted in FIG. 9.
Figure 13B:
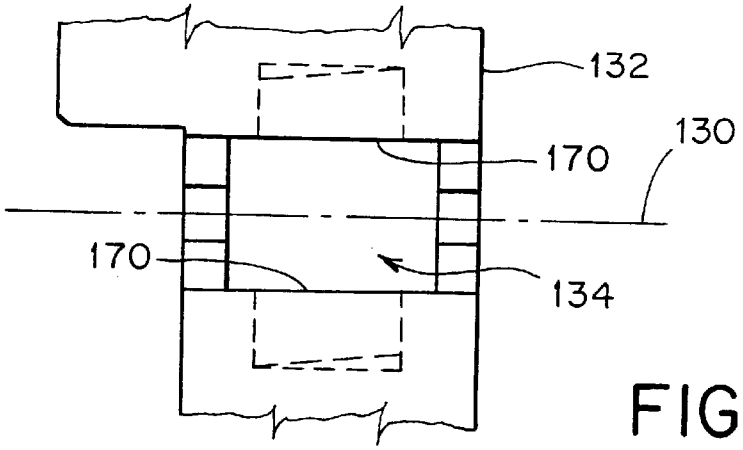
FIG. 13B is a plan view taken in direction 13B—13B of FIG. 13A.

Reference should now be had to FIGS. 13A–13D which show further details of the insulation-displacement-contact-receiving cavity 134 of the connector block 132 of the present invention. As best seen in FIGS. 13A and 13B, the walls defining cavities 134 preferably terminate in a stop lip 170. Stop lips 170 prevent insulation displacement contact 100 from being pushed out of cavity 134.

Figure 13C:
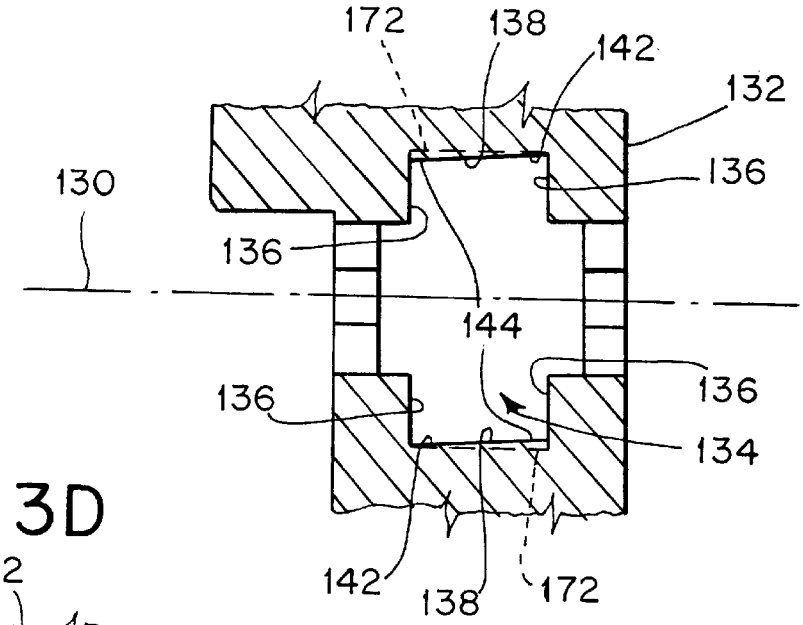
FIG. 13C is a cross-sectional plan view taken along line 13C—13C of FIG. 13A.
Figure 13D:
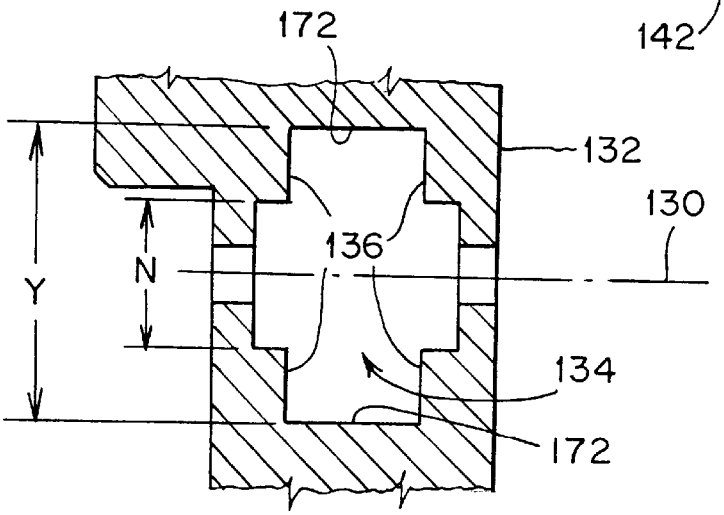
FIG. 13D is a cross-sectional plan view taken along line 13D—13D in FIG. 13A.

With reference to FIGS. 13A and 13C, it will be appreciated that the angled second pair of parallel walls 138 preferably only extend a distance K below stop lip 170. Although it is possible to have the angled walls extend all the way to the bottom of the cavity 134, the termination at a distance K, which is preferably at the top of the narrow part 20 of slot 16 (with reference to the prior art drawing; same for present invention), has been found to result in reliable functioning. In practice, for the dimensions of contacts set forth herein, the distance K can be about 0.060–0.070 inches (1.5–1.8 mm). Thus, radiused loop portion 160 bottoms out on stop lip 170 when contact 100 is inserted into cavity 134. Beneath the end of the angled second pair of parallel walls 138, the cavity 134 can assume its full width with parallel walls 172 which are perpendicular to the first pair of parallel walls 136, as shown in FIG. 13D and in phantom in FIG. 13C. With continued reference to FIG. 13D, it will be appreciated that walls 172 are located a distance Y apart (refer back to FIG. 9). Further, distance N can be about 0.068 inches (1.7 mm); and in FIG. 9, distance L can be about 0.072 inches (1.8 mm) and distance M can be about 0.11 inches (2.8 mm). Again, all of the foregoing dimensions are for use with an insulation displacement contact having exemplary dimensions as set forth elsewhere herein, and can be adjusted by scaling for larger or smaller contacts.

A method, according to the present invention, of securing two insulated wires, each of which has insulation and a conductor, will now be discussed. The method includes the steps of providing an insulation displacement contact; supporting the insulation displacement contact in a connector block having an insulation-displacement-contact-receiving cavity therein; and inserting the two insulated wires into a tortuous path defined by first and second leaf longitudinal slots of the insulation displacement contact. The insulation displacement contact which is provided in the first step preferably includes a first generally planar leaf element 102 of the type described above, including the first leaf longitudinal centerline 104, first leaf longitudinal slot 106, first leaf relieved edge 108, and first leaf opposed cutting edge 110, all as described above. Further, the insulation displacement contact provided in the first step preferably also includes a second generally planar leaf element 112 of the type described above, which has a longitudinal centerline 114, second leaf longitudinal slot 116, second leaf relieved edge 118 and second leaf opposed cutting edge 120, again, as described above. The first leaf longitudinal slot 106 and the second leaf longitudinal slot 116, of the contact provided in the first step, preferably define a tortuous path for receiving the two insulated wires, with the first leaf relieved edge 108 and the second leaf relieved edge 118 defining open regions for receiving portions of the insulation of the two insulated wires which are displaced from the wires during the subsequent insertion step.

In the step of supporting the insulation displacement contact, the connector block which is employed is preferably similar to the type of connector block 132 described above. Block 132, as noted, has at least one insulation-displacement-contact-receiving cavity 134. The shape of the cavity 134 is as described above. Note, however, with reference to both the apparatus and method of the present invention, that the second pair of parallel walls 138 are best described as being sized and shaped to provide the back-up portions 144 which back up the cutting edges 110, 120, such that when the insulation displacement contact 100 is supported in the insulation-displacement-contact-receiving cavity 134 of the connector block 132, the back-up portions 144 back up the first and second leaf cutting edges 110, 120, cause them to move towards the first and second leaf relieved edges 108, 118 and substantially fix them against in-plane motion.

Finally, the step of inserting the two insulated wires into the tortuous path defined by the first and second leaf longitudinal slots 106, 116 it is performed such that the first and second leaf opposed cutting edges 10, 120 cut through the insulation 126 to make electrical contact with the conductors of the wires 122, 124 and such that the open regions 128 defined by the first and second leaf relieved edges 108, 118 receive portions of the insulation 126 of the two insulated wires 122, 124 which are displaced from the wires.

The method can further comprise the additional step of dimensioning the backup portions 144 of the second pair of parallel walls 138 to push the cutting edges 110, 120 beyond the longitudinal plane 130 during the supporting step. Further, the method can also comprise the additional step of forming the second pair of parallel walls 138 with clearance portions 142 which are located adjacent the first and second leaf relieved edges 108, 118 such that the relieved edges 108, 118 are substantially free to move in plane during the supporting step.

In the step of providing the insulation displacement contact, the first leaf element 102 of the insulation displacement contact 100 can preferably be divided into a first leaf first prong 146 and a first leaf second prong 148 of the type described above, and the second leaf element 112 can be divided into a second leaf first prong 150 and a second leaf second prong 152 of the type described above. In this case, the method can include the additional step of subjecting the first and second-side path-bounding arms 154, 156 (as described above) to substantial tortional loads about axes parallel to the longitudinal plane 130 when the two insulated wires 122, 124 are inserted into the tortuous path, such that the first leaf first prong and second leaf first prong 146, 150 twist towards the clearance portions 142 of the second pair of parallel walls 138.

Yet further, the method can include the additional steps of dimensioning the insulation displacement contact 100 such that the first leaf element 102 and the second leaf element 112 form an angle of about 3–15° before the contact 100 is supported in the insulation-displacement-contact-receiving cavity 134 of the connector block 132; and further dimensioning the cavity 134 and the contact 100 such that the first leaf element 102 and the second leaf element 112 form an angle of about 3° when the insulation displacement contact 100 is supported in the insulation-displacement-contact-receiving cavity 134 of the connector block 132.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An assembly for receiving two insulated wires, each having insulation and a conductor, said assembly comprising the combination of:

(a) an insulation displacement contact comprising:

(i) a first generally planar leaf element having a first leaf longitudinal centerline lying in a longitudinal plane, said longitudinal plane being generally perpendicular to said first leaf element, said first leaf element being formed with a first leaf longitudinal slot defined by a first leaf relieved edge and a first leaf opposed cutting edge which is spaced from said first leaf relieved edge, said first leaf relieved edge being located on a first side of said longitudinal plane, said first leaf opposed cutting edge being spaced from said first leaf relieved edge in a direction towards said first leaf longitudinal centerline; and (ii) a second generally planar leaf element which is secured to said first leaf element, said second leaf element having a second leaf longitudinal centerline lying in said longitudinal plane, said longitudinal plane being generally perpendicular to said second leaf element, said second leaf element being formed with a second leaf longitudinal slot defined by a second leaf relieved edge and a second leaf opposed cutting edge, said second leaf relieved edge being located on a second side of said longitudinal plane, said second leaf opposed cutting edge being spaced from said second leaf relieved edge in a direction towards said second leaf longitudinal centerline;

wherein said first leaf longitudinal slot and said second leaf longitudinal slot define a tortuous path for receiving the two insulated wires, said first leaf opposed cutting edge and said second leaf opposed cutting edge cutting through the insulation of the two insulated wires, when the wires are received in said path, to make electrical contact with the conductors of the wires, said first leaf relieved edge and said second leaf relieved edge defining open regions which receive portions of the insulation of the two insulated wires which are displaced therefrom; and (b) a connector block having an insulation-displacement-contact-receiving cavity defined therein by first and second pairs of generally parallel walls, said contact being inserted in said cavity, said cavity having a generally parallelogram cross section with said first pair of parallel walls oriented perpendicular to said longitudinal plane, said cavity having a longitudinal axis lying generally in said longitudinal plane, said second pair of parallel walls being sized and shaped to provide back-up portions, such that when said insulation displacement contact is inserted in said insulation-displacement-contact-receiving cavity, said first leaf cutting edge and said second leaf cutting edge are adjacent said back-up portions of said second pair of parallel walls, said back-up portions backing up said cutting edges, such that said first and second leaf cutting edges are moved towards said first and second leaf relieved edges respectively and are substantially fixed against in-plane motion.

2. The assembly of claim 1, wherein said back-up portions of said second pair of parallel walls are dimensioned to push said cutting edges beyond said longitudinal plane when said insulation displacement contact is inserted into said insulation-displacement-contact-receiving cavity of said connector block.

3. The assembly of claim 2, wherein, when said insulation displacement contact is not inserted into said insulation-displacement-contact-receiving cavity, said first leaf opposed cutting edge is located at least as far away from said first leaf relieved edge as said first leaf longitudinal centerline and said second leaf opposed cutting edge is located at least as far away from said second leaf relieved edge as said second leaf longitudinal centerline.

4. The assembly of claim 3, wherein said second pair of parallel walls are formed with clearance portions such that said first leaf relieved edge and said second leaf relieved edge, when said insulation displacement contact is inserted in said insulation-displacement-contact-receiving cavity, are adjacent said clearance portions of said second pair of parallel walls, said clearance portions angling away from said relieved edges such that said relieved edges are substantially free to move in plane.

5. The assembly of claim 4, wherein:

said first leaf element is divided into:

a first leaf first prong located on said first side of said longitudinal plane and bounded by said first leaf relieved edge; and a first leaf second prong primarily located on said second side of said longitudinal plane and bounded by said first leaf opposed cutting edge;

said second leaf element is divided into:

a second leaf first prong located on said second side of said longitudinal plane and bounded by said second leaf relieved edge, said second leaf first prong being joined to said first leaf second prong to form a second-side path-bounding arm; and a second leaf second prong primarily located on said first side of said longitudinal plane and bounded by said second leaf opposed cutting edge, said second leaf second prong being joined to said first leaf first prong to form a first-side path-bounding arm; and said first- and second-side path-bounding arms are subjected to substantial torsional loads about axes parallel to said longitudinal plane when the two insulated wires are inserted in said tortuous path, such that said first leaf first prong and said second leaf first prong twist towards said clearance portions of said second pair of parallel walls.

6. The assembly of claim 5, wherein:

said tortuous path has an open end for receiving the two wires;

said second leaf first prong is joined to said first leaf second prong adjacent said open end of said tortuous path; and said second leaf second prong is joined to said first leaf first prong adjacent said open end of said tortuous path.

7. The assembly of claim 6, wherein:

said second leaf first prong is joined to said first leaf second prong with a radiused loop portion; and said second leaf second prong is joined to said first leaf first prong with a radiused loop portion.

8. The apparatus of claim 6, wherein:

said first leaf element and said second leaf element form an angle of about 3–15 degrees when said insulation displacement contact is not inserted in said insulation-displacement-contact-receiving cavity of said connector block; and said first leaf element and said second leaf element form an angle of about 3 degrees when said insulation displacement contact is inserted in said insulation-displacement-contact-receiving cavity of said connector block.

9. A method of securing two insulated wires, each having insulation and a conductor, said method comprising the steps of:

(a) providing an insulation displacement contact comprising:

(i) a first generally planar leaf element having a first leaf longitudinal centerline lying in a longitudinal plane, said longitudinal plane being generally perpendicular to said first leaf element, said first leaf element being formed with a first leaf longitudinal slot defined by a first leaf relieved edge and a first leaf opposed cutting edge which is spaced from said first leaf relieved edge, said first leaf relieved edge being located on a first side of said longitudinal plane, said first leaf opposed cutting edge being spaced from said first leaf relieved edge in a direction towards said first leaf longitudinal centerline; and (ii) a second generally planar leaf element which is secured to said first leaf element, said second leaf element having a second leaf longitudinal centerline lying in said longitudinal plane, said longitudinal plane being generally perpendicular to said second leaf element, said second leaf element being formed with a second leaf longitudinal slot defined by a second leaf relieved edge and a second leaf opposed cutting edge, said second leaf relieved edge being located on a second side of said longitudinal plane, said second leaf opposed cutting edge being spaced from said second leaf relieved edge in a direction towards said second leaf longitudinal centerline;

wherein said first leaf longitudinal slot and said second leaf longitudinal slot define a tortuous path for receiving the two insulated wires, said first leaf relieved edge and said second leaf relieved edge defining open regions for receiving portions of the insulation of the two insulated wires which are displaced therefrom during subsequent insertion;

(b) supporting said insulation displacement contact in a connector block having an insulation-displacement-contact-receiving cavity defined therein by first and second pairs of generally parallel walls, said cavity having a generally parallelogram-shaped cross section with said first pair of parallel walls oriented perpendicular to said longitudinal plane, said cavity having a longitudinal axis lying generally in said longitudinal plane, said second pair of parallel walls being sized and shaped to provide back-up portions which back up said cutting edges, such that when said insulation displacement contact is supported in said insulation-displacement-contact-receiving cavity of said connector block, said back-up portions back up said first and second leaf cutting edges and cause them to move towards said first and second leaf relieved edges respectively and substantially fix them against in-plane motion; and (c) inserting the two insulated wires into the tortuous path defined by the first and second leaf longitudinal slots such that said first and second leaf opposed cutting edges cut through the insulation of the two insulated wires to make electrical contact with the conductors of the wires and such that the open regions defined by the first and second leaf relieved edges receive portions of the insulation of the two insulated wires which are displaced from the wires.

10. The method of claim 9, further comprising the additional step of dimensioning said back-up portions of said second pair of parallel walls to push said cutting edges beyond said longitudinal plane during said supporting step.

11. The method of claim 10, further comprising the additional step of forming said second pair of parallel walls with clearance portions which are located adjacent said first and second leaf relieved edges such that said relieved edges are substantially free to move in plane during said supporting step.

12. The method of claim 11, wherein:

said first leaf element is divided into:

a first leaf first prong located on said first side of said longitudinal plane and bounded by said first leaf relieved edge; and a first leaf second prong located on said second side of said longitudinal plane and bounded by said first leaf opposed cutting edge;

said second leaf element is divided into:

a second leaf first prong located on said second side of said longitudinal plane and bounded by said second leaf relieved edge, said second leaf first prong being joined to said first leaf second prong to form a second-side path-bounding arm; and a second leaf second prong located on said first side of said longitudinal plane and bounded by said second leaf opposed cutting edge, said second leaf second prong being joined to said first leaf first prong to form a first-side path-bounding arm;

said method further comprising the additional step of:

subjecting said first and second-side path-bounding arms to substantial torsional loads about axes parallel to said longitudinal plane when the two insulated wires are inserted in said tortuous path, such that said first leaf first prong and said second leaf first prong twist towards said clearance portions of said second pair of parallel walls.

13. The method of claim 9, further comprising the additional steps of:

dimensioning said insulation displacement contact such that said first leaf element and said second leaf element form an angle of about 3–15° before said insulation displacement contact is supported in said insulation-displacement contact-receiving cavity of said connector block; and dimensioning said cavity and said insulation displacement contact such that said first leaf element and said second leaf element form an angle of about 3° when said insulation displacement contact is supported in said insulation-displacement-contact-receiving cavity of said connector block.

* * * * *